United States Patent [19]

Brewster

[11] 3,990,979

[45] Nov. 9, 1976

[54] LOW ASH ANTIRUST DISPERSANT ADDITIVE

[75] Inventor: Philip W. Brewster, Camlachie, Canada

[73] Assignee: Exxon Research and Engineering Company, Linden, N.J.

[22] Filed: Oct. 23, 1974

[21] Appl. No.: 517,386

[52] U.S. Cl. ..... 252/41; 252/389 R

[51] Int. Cl.[2] ..... C10M 1/24; C10M 3/18; C10M 5/14; C10M 7/20

[58] Field of Search ..... 252/41, 389 R

[56] References Cited

UNITED STATES PATENTS

| | | | |
|---|---|---|---|
| 3,219,582 | 11/1965 | Gaertner | 252/41 |
| 3,271,310 | 9/1966 | Le Suer | 252/41 |
| 3,351,552 | 11/1967 | Le Suer | 252/41 |

*Primary Examiner*—Delbert E. Gantz
*Assistant Examiner*—I. Vaughn
*Attorney, Agent, or Firm*—Frank T. Johmann

[57] ABSTRACT

Half lithium salts of aliphatic hydrocarbon substituted succinic anhydrides and acids are reacted with polyhydric alcohols to provide an effective rust and corrosion inhibiting additive preferably having dispersant properties for lubricating oil compositions.

6 Claims, No Drawings

LOW ASH ANTIRUST DISPERSANT ADDITIVE

BACKGROUND OF THE INVENTION

1. Field of the Invention

This invention relates to new chemical compositions and to lubricating oil compositions containing these compositions. More particularly, it relates to a novel class of chemical compositions which in part act both as rust and corrosion inhibitors and dispersants in lubricating oils.

2 Description of the Prior Art

The prior art has taught the need for efficient rust inhibitors in lubricating oils. The need is particularly prevalent in engines which are infrequently operated or which are subject to extended storage in humid climates, because these engines experience excessive rusting of cylinder walls, wrist pins and other polished working surfaces. Under such conditions moisture accumulates within the engine, penetrates the lubricating film and attacks ferrous surfaces. This attack is aggravated by residues of chlorine and bromine compounds produced in the combustion of gasolines containing tetraethyl lead and scavenging agents such as ethylene dibromide.

Any such deterioration results in the accumulation of products which agglomerate to form sludge and varnish-like deposits. It is highly useful to delay this agglomeration by an additive which disperses such products as they are formed.

Certain alkyl and alkenyl succinic anhydrides, acids, and various salts thereof have been proposed as ashless or low ash rust inhibitors for motor lubricants, e.g., such materials are described in U.S. Pat. No. 3,381,022. Unfortunately, these compounds, although having rust inhibiting properties fail to usefully disperse the corrosion products which do inevitably form over the operational lifetime of the device in which the lubricant is used or the fuel is converted to mechanical energy.

Accordingly, there has been a continuing search for new and improved economical, low ash rust inhibitors which are compatible with other lubricating oil additives and do reduce corrosion and/or sludge formation.

SUMMARY OF THE INVENTION

It has now been discovered that the half-lithium salts of aliphatic-hydrocarbon-substituted succinic anhydrides and acids (designated ASA), can be reacted with organic hydroxy compounds to provide an effective low-ash, rust and corrosion inhibitor for lubricating oil compositions. The combination of hydroxy compound with the half-lithium salts of succinic anhydrides and acids, produces low ash, nitrogen free, compositions that provide excellent rust inhibition and which are compatible with other additives generally present in lubricating oils.

The new rust inhibitors of the present invention are mixed ester-lithium metal salts of ASA, and preferably are ester-polylithium salts having at least two pendant hydroxyl groups. The hydrocarbon substituent of the ASA preferably contains at least 50 aliphatic carbon atoms, although it can contain from 9 to about 30 carbon atoms. The mixed ester-lithium salts of ASA are generally incorporated in lubricating oil at a concentration of from about 0.2 weight percent to about 10 weight percent, based on the weight of the lubricating oil.

DETAILED DESCRIPTION

In accordance with the invention, the novel mixed ester-lithium salts of an aliphatic-hydrocarbon-substituted succinic anhydride or acid are prepared by reacting a half-lithium salt of an aliphatic-hydrocarbon-substituted succinic anhydride or acid with an organic hydroxy compound. The half-lithium salts can be prepared by reacting an aliphatic-hydrocarbon-substituted succinic anhydride or acid (ASA) with a lithium base such as lithium oxide, lithium hydroxide, lithium carbonate or lithium alkoxide. The hydrocarbon substituent of the ASA is an aliphatic hydrocarbon group having at least 9 aliphatic carbon atoms, and preferably is a high molecular weight group having at least 50 aliphatic carbon atoms in its structure, although lower molecular weight groups having from 9 to about 30 aliphatic carbon atoms can also be used. The provision of a hydrocarbon substituent having at least 50 aliphatic carbon atoms enhances the oil solubility of the products of the present invention and enables them to be used in lubricating oils without dispersants. The molecular weight of hydrocarbon substituents having at least 50 aliphatic carbon atoms generally is in the range of 700 to about 100,000.

The high molecular weight hydrocarbon-substituted succinic compounds which are used to obtain the lithium salts are readily obtainable from the reaction of maleic anhydride or maleic acid and a high molecular weight olefin or a chlorinated hydrocarbon or other high molecular weight hydrocarbon containing an activating polar substituent, i.e., a substituent which is capable of activating the hydrocarbon molecule with respect to the reaction with maleic anhydride or the acid thereof. This reaction involves heating equivalent portions of maleic anhydride and the hydrocarbon, for example, at a temperature of about 100°–200° C. The resulting product is a hydrocarbon-substituted succinic anhydride. The succinic anhydride may be hydrolyzed to the corresponding acid by treatment with water or steam.

The principal sources of high molecular weight hydrocarbon-substituted radicals include the high molecular weight petroleum fractions and olefin polymers, particularly polymers of monoolefins having from 2 to about 30 carbon atoms. Especially useful are the polymers of 1-monoolefins such as ethylene, propene, 1-butene, isobutene, 1-hexene, 1-octene, 2-methyl-1-heptene, 3-cyclohexyl-1-butene, and 2-methyl-5-propyl-1-hexene. Polymers of medial olefins, i.e., olefins in which the olefinic linkage is not at the terminal position, are likewise useful. Such medial olefin polymers are illustrated by 2-butene, 3-pentene, 4-octene, etc.

Also useful in providing high molecular weight hydrocarbon substituted radicals are the interpolymers of olefins such as those illustrated above with other interpolymerizable olefinic substances such as aromatic olefins, cyclic olefins, and polyolefins. Such interpolymers include, for example, those prepared by polymerizing isobutene with styrene, isobutene with butadiene, propene with isoprene, isobutene with p-methylstyrene, 1-heptene with 1-pentene, isobutene with styrene and piperylene, etc.

The relative proportions of the monoolefins to the other monomers in the high molecular weight interpolymers influence the stability and oil-solubility of the productions of this invention. Thus, where good oil-solubility and stability is desired, the high molecular weight interpolymers contemplated for use in this invention should be substantially aliphatic and substantially saturated, ie., they should contain at least about 80% and preferably at least about 95%, on a weight basis, of units derived from the aliphatic monoolefins and no more than about 5% of olefinic linkages based on the total number of carbon-to-carbon covalent linkages. In most instances, the percent of olefinic linkages should be less than about 2% of the total number of carbon-to-carbon covalent linkages. An excessive proportion of unsaturated linkages renders the molecule susceptible to oxidation, deterioration, and polymerization and results in products unsuitable for use in hydrocarbon oils in many applications.

Another source of the high molecular weight hydrocarbon substituent radicals includes saturated aliphatic hydrocarbons derived from highly refined high molecular weight white oils or synthetic alkanes such as are obtained by hydrogenation of the high molecular weight monoolefin polymers illustrated above or other high molecular weight olefinic substances.

As previously discussed, the molecular weight of the high molecular weight hydrocarbon substituent preferably should be within the range of about 700 to about 100,000. Olefin polymers having a molecular weight of about 750 to 5,000 are preferred. A particularly preferred polyolefin is polyisobutene having a molecular weight of about 1,000. However, still higher molecular weight olefin polymers having molecular weights from about 10,000 to about 100,000 are also useful and have been found to impart viscosity index improving properties to the metal salt compositions of this invention. In many instances, the use of such higher molecular weight olefin polymers is desirable.

The ASA used in preparing the half-lithium salts can also have a low molecular hydrocarbon substituent such as $C_9$ to $C_{30}$ alkyl or alkenyl groups.

The low molecular weight alkenyl-substituted or alkyl-substituted succinic acids and anhydrides used in forming the half-lithium salts used in this invention preferably have an aliphatic hydrocarbon substituent of 10 to 20 carbon atoms. Low molecular weight alkenyl-substituted acids and anhydrides can be straight chained and are obtained by conventional methods known in the art which involve heating maleic anhydride and an olefinic material together, usually in about equal molar portions. For example, a $C_{10}$ to $C_{12}$ alkenyl succinic acid anhydride can be prepared by the condensation of maleic acid anhydride and a $C_{10}$ to $C_{12}$ fraction of propylene polymer. The reactants are heated with agitation for 20 hours under pressure at a temperature of about 350° to 390° F. under gentle reflux. The reaction product is then allowed to cool and is fractionated under diminished pressure to remove unreacted polymer and low-boiling reaction products. The resulting low molecular weight alkenyl succinic acid anhydride can then be employed directly to produce the half-salts hereinafter described.

Alternatively the low molecular weight anhydrides can be readily purchased as a commercial chemical commodity. In the present invention, either hydrocarbon substituted succinic anhydrides or the corresponding acids can be used and it is to be understood that any general description involving the use of the anhydride is intended to encompass the use of the equivalent acid as well and vice versa.

Among the low molecular weight alkenyl-substituted succinic acids and anhydrides which can be used according to the present invention are nonenyl, decenyl, tetradecenyl, hexadecenyl, octadecenyl, eicosenyl, hexaeicosenyl and octaeicosenyl succinic anhydride or acid, and mixtures thereof. A particularly preferred low molecular weight material is dodecenyl succinic anhydride (hereinafter referred to as DDSA) which can readily be prepared by the addition of tetrapropylene to maleic anhydride.

In place of the low molecular weight alkenyl succinic acid or anhydride, the corresponding saturated acid or anhydride, or mixtures of saturated and unsaturated materials, can be used. Conversion of the alkenyl group to the alkyl group is usually accomplished by hydrogenation to saturate the double bond, using procedures well known in the art. See U.S. Pat. No. 2,682,489. Among the low molecular weight alkyl substituted succinic anhydrides which can be used are n-dodecyl, n-tetradecyl and hexadecyl succinic anhydride and mixtures thereof.

In addition to the pure hydrocarbon substituents described above, it is intended that the term "hydrocarbon substituent," as used in the specification and claims, include substantially hydrocarbon substituents. For example, the hydrocarbon substituent may contain polar substituents provided, however, that the polar substituents are not present in proportions sufficiently large to alter significantly the hydrocarbon character of the radical. The polar substituents contemplated are exemplified by chloro, bromo, keto, aldehyde, ether, nitro, etc.

The half-lithium salts of the aliphatic-hydrocarbon-substituted succinic anhydrides and acids used in the present invention can be prepared by reacting the ASA and lithium base over a wide temperature range of from about 50° F. to about 350° F. Preferably, the reaction temperature ranges from about 150° to about 300° F. Usually, a stoichiometric amount of lithium base sufficient to prepare the half-salt of the dicarboxylic hydrocarbon-substituted succinic acid is used.

In accordance with the invention, the above described half-lithium salts of succinic acids and anhydrides are reacted with polyhydroxy compounds to esterify the half-lithium salts and thereby produce mixed ester-lithium salts. The polyhydroxy compounds that can be used include the aliphatic, cyclic, alicyclic, and other polyhydric alcohols. These polyhydric alcohols from which the esters may be derived preferably contain up to about 40 carbon atoms. Polyhydric alcohols that can be used usually contain from 2 to about 10 hydroxy radicals and are illustrated by, for example, ethylene glycol, diethylene glycol, triethylene glycol, tetraethylene glycol, dipropylene glycol, tripropylene glycol, dibutylene glycol, tributylene glycol, and other alkylene glycols in which the alkylene radical contains from 2 to 8 carbon atoms. Other useful polyhydric alcohols include: glycerol, monomethyl ether of glycerol, pentaerythritol, 9,10-dihydroxy stearic acid, 1,2-butanediol, 2,3-hexanediol, 2,4-hexanediol, pinacol, erythritol, arabitol, sorbitol, mannitol, 1,2-cyclohexanediol, xylene glycol, and polyhydric alcohols having at least three hydroxy radicals some of which have been esterified with a monocarboxylic acid having from about 8 to about 30 carbon atoms such as octanoic acid, oleic acid, stearic acid, linoleic acid, dodecanoic acid, or tall oil acid. Examples of such partially esterified polyhydric alcohols are the monooleate of sorbitol, distearate of sorbitol, di-dodecanoate of erythritol, mono-oleate of glycerol and monostearate of glycerol.

Carbohydrates such as sugars, starches, celluloses, etc., likewise may yield the esters of this invention. The carbohydrates may be exemplified by glucose, fructose, sucrose, rhamnose, mannose, glyceraldehyde, and galactose. Pentaerythritol is a preferred polyhydric alcohol for use in the present invention.

The esters of this invention may be prepared by one of several methods. The method which is preferred because of convenience and superior properties of the esters it produces, involves the reaction of a suitable alcohol with the half-lithium salt of the substantially hydrocarbon-substituted succinic anhydride. The esterification is usually carried out at a temperature in the range of about 200° to about 500° F., preferably between 250° and 300° F., although other temperatures can be used. The reaction is usually allowed to proceed from about 2 to about 10 hours, and preferably between 4 to 8 hours. The reaction usually is carried out at atmospheric pressures, although other pressures can also be used.

Water is formed as a by-product and is removed by distillation as the esterification proceeds. A solvent may be used in the esterification to facilitate mixing and temperature control. It also facilitates the removal of water from the reaction mixture. The useful solvents include xylene, toluene, diphenyl ether, chlorobenzene, and mineral oil.

In some instances it is advantageous to carry out the esterification in the presence of a catalyst such as sulfuric acid, pyridine hydrochloride, hydrochloric acid, benzene sulfonic acid, p-toluene sulfonic acid, phosphoric acid, or any other known esterification catalyst. The amount of the catalyst in the reaction may be as little as 0.01% (by weight of the reaction mixture), more often from about 0.1% to about 5%.

The relative proportions of the half-lithium salt succinic reactant and the hydroxy reactant which are to be used depend to a large measure upon the type of the product desired and the number of hydroxyl groups present in the molecule of the hydroxy reactant. For example, in the formation of a mixed half-ester monolithium salt of a succinic acid, i.e., one in which only one lithium and one ester group are present in the compound, one mole of a dihydric alcohol is used for each mole of the substituted succinic acid reactant. On the other hand, one mole of a hexahydric alcohol may combine with as many as five moles of a succinic acid to form an ester in which five of the six hydroxyl radicals of the alcohol is esterified with the acid radical of the half-lithium salt of the ASA. Thus, the maximum proportion of the succinic acid to be used with a polyhydric alcohol is determined by the number of hydroxyl groups present in the molecule of the hydroxy reactant to provide at least one pendant hydroxy group in the molecule. For the purposes of this invention, esters obtained by the reaction of one mole of the half-lithium salt succinic reactant and one mole of a hydroxy reactant containing at least two and preferably at least three hydroxy groups, are preferred.

In the present invention, the mixed ester-lithium salt additives of the present invention are prepared to contain at least one, and preferably at least two, pendant or free hydroxy groups. While the inventor does not wish to be bound by any particular theory, it is believed that effective rust inhibition is obtained by providing an inhibitor which is bonded to the surface to be protected. In the present invention, it is believed that the half-lithium succinic acid salt portion of the additive provides the rust inhibition while the hydroxy groups provide the polarity required for a good surface bond. The strength of the bond, of course, depends on the number of polar groups available, and free or pendant groups provide stronger polar bonds than non-pendant groups. Accordingly, the reactants, mole ratios, and methods of preparation used in the present invention are selected to provide at least one, and preferably at least two pendant hydroxy groups in ester-metal salt additives. An especially preferred ester-metal salt additive can be prepared as a dilithium salt having two pendant hydroxy groups by reacting two moles of a half-lithium salt succinic reactant with one mole of a polyhydric compound containing four hydroxyl groups such as, for example, pentaerythritol.

The high molecular weight ester-metal salts of ASA's containing at least 50 aliphatic carbon atoms in the hydrocarbon substituent are soluble and easily dispensable in lubricating oil compositions and no further treatment is necessary. The low molecular weight ester-metal salts of ASA's containing from 9 to about 30 carbons in the hydrocarbon substituent, however, are not especially soluble in lubricating oil compositions, and when using these compounds a dispersing agent or solubilizing agent preferably is employed. Suitable dispersing agents include an amide condensate of polyisobutenyl propionic acid and tetraethylene pentamine (see British Pat. No. 1,075,121).

While it is possible to disperse the low molecular weight mixed-ester lithium salts of $C_9$ to $C_{30}$ alkenyl or alkyl succinic anhydrides or acids into lubricating oil compositions with the aid of the dispersing agents, it is much preferred to work with oil soluble additives as opposed to oil dispersable additives. Furthermore, as a practical matter, it is preferred and predominantly the practice to blend additives into lubricating compositions in concentrate form. Usually in a concentrate, the weight percent of active ingredient ranges from about 10 to about 80 weight percent, for there is no economic advantage in using concentrates having less than 10 weight percent active ingredient. However, if one attempts to prepare concentrates wherein the weight percentage of low molecular weight mixed-ester lithium salt of ASA is greater than 10, using dispersants, such concentrates will form solid gels at ambient temperatures, thus presenting a number of disadvantages in their handling in subsequent blending operations.

There are a number of oxygen-containing compounds which will solubilize the mixed-ester lithium salts of aliphatic-hydrocarbon-substituted succinic acids or anhydrides. Among these are tall oil fatty acids and alcohols such as iso-octanol and nonanol. Of all the oxygen-containing material that can be used as solubilizers, the alkyl phenols are preferred because they make the mixed-ester lithium salts soluble in lubricating oils without destroying the copper-lead corrosion inhibiting properties of the salts and allow the preparation of a stable liquid concentrate. The phenols that can be used include alkyl phenols having a total of 5 to 30, and preferably 8 to 26, carbon atoms in their alkyl side chains and may be polyhydric phenols containing more than one ring structure.

The preferred phenols are monoalkylated monohydroxy phenols whose molecular weights are between 150 and 700. Especially preferred are monoalkylated phenols having 8 to 12 alkyl carbon atoms. Particularly effective compounds include p-octyl phenol, mixed nonyl phenols, mixed dodecyl phenols, and dihexyl phenol.

The phenol that is used to solubilize the mixed-ester lithium ASA salts is added to the mixed-ester lithium salt after it is formed. Reaction time of combining these components is not critical. The only requirement is that the phenol be present while the temperature of the mixture is at least as high as the melting point of the salt. Thus, the solubilization which must be carried out while the salt is in liquid phase can be effected at a temperature range of about 300° to about 500° F., and preferably at a temperature range of about 350° to about 450° F.

It is to be understood that the exact nature of the compositions formed upon the addition of the alkyl phenol has not been determined and, while they have been referred to as solubilized mixed-ester lithium salts, it is possible that a lithium phenate complex has been formed between the ASA, the lithium base, and the alkyl phenol or that some other undetermined compositional structure has resulted.

While experiments indicate that in the preferred embodiments of the invention the mole ratio of salt to phenol will range from about 8:1 to about 1:1, ratios ranging from about 15:1 to about 0.5:1 will in many cases also result in the desired oil soluble product.

The final oil compositions generally will include the ester-metal salt additives of this invention in an amount of at least 0.2 weight percent, to about 10 weight percent based on the weight of the oil. The additives of the present invention usually are incorporated in the oil in the amount of about 0.2 to 6, preferably 0.4 to 2 weight percent, based on the weight of the oil.

The additives of the invention are used in mineral lubricating oils, and also in synthetic oils. The mineral lubricating oils can be of any preferred type, including those derived from the ordinary paraffinic, naphthenic, asphaltic, or mixed base mineral crude oils by suitable refining methods. Suitable synthetic oils include synthetic hydrocarbon lubricating oils, as well as dibasic acid esters such as di-2-ethyl hexyl sebacate, carbonate esters, phosphate esters, halogenated hydrocarbons, polysilicones, polyglycols, glycol esters such as $C_{13}$ Oxo acid diesters of tetraethylene glycol, and complex esters, as for example the complex ester formed by the reaction of 1 mole of sebacic acid with 2 moles of tetraethylene glycol and 2 moles of 2-ethyl hexanoic acid.

While the lubricant compositions herein described are primarily designated as internal combustion engine crankcase lubricants, the additives of the invention may also be employed in other oil compositions, including turbine oils, various industrial oils, gear oils, hydraulic fluids, transmission fluid and the like.

It is within the contemplation of this invention to prepare easily handled liquid additive concentrates in which the concentration of additives is greater than would normally be employed in a finished lubricant. These concentrates may contain in the range of from 6 to 50 weight percent of additive on an active ingredient basis, the balance being mineral oil. Preferably, the concentrates contain at least about 10 weight percent of additive. The concentrates are convenient for handling the additive in the ultimate blending operation into a finished lubricating oil composition. The additive concentrates can be made up simply by combining the reaction product of the present invention in a suitable mineral oil medium.

The additive package can also include other additives that are intended for use in a finished lubricant. These additional additives can be present in amounts up to about 15 percent by weight of the finished lubricating oil composition. Such additives include, for example, detergents and dispersants of the ash-containing or ashless type, oxidation inhibiting agents, viscosity index improving agents, pour point depressants, color stabilizers and antifoam agents.

Suitable additives for these purposes are known to those skilled in the art. For example, crankcase lubricating oils can contain polymers such as polyisobutylene, polymethacrylates, copolymers of alkyl fumarates with vinyl acetate and various other long chain polymers usually having molecular weight of about 5,000 to 25,000 as viscosity index improvers and pour point depressants. Oxidation inhibitors frequently used in such compositions include, for example, phenyl-$\alpha$ naphthylamine, and detergent additives include metal salts of alkyl phenol sulfides and complexes of various $P_2S_5$ treated hydrocarbons neutralized with metal bases or metal salts of other materials such as phenols, sulfonates, carbonates, and the like.

DESCRIPTION OF THE PREFERRED EMBODIMENTS

The following examples will serve to illustrate methods of preparing the compositions of this invention and include preferred embodiments of said invention.

Example 1

The half-lithium salt of polyisobutylene succinic acid is prepared by diluting one mole of polyisobutylene succinic anhydride having a molecular weight of about 900 with an equal volume of SAE 10 grade oil. The mixture is heated to 260° to 280° F. in a Hobart mixer and an aqueous solution containing 1 mole of lithium hydroxide in 250 grams of hot water is added dropwise over a period of 20 minutes. At this temperature, all of the water flashes off and is rapidly evaporated. Upon completion of the addition of the lithium hydroxide solution, the temperature is raised to 430° to 450° F. and one-half mole of pentaerythritol is added. A catalyst in the form of 0.25% toluene sulfonic acid is added and the esterification is carried out for 6 hours. The resulting product was a clear amber viscous fluid which had a viscosity of 1000 S.U.S. at 210° F. and contained about 0.7 wt. % lithium.

Example 2

The compatibility of the additives of the present invention with other conventional motor oil additives is tested by blending 6 weight percent of the additive of Example 1 (on an active ingredient basis) with 94 weight percent of a motor oil blend free of rust inhibitor described in detail below.

The blended motor oil free of rust inhibitor is prepared by blending the following components at 120° F.: (1) 1.2 weight percent of an oil composition consisting of 26 weight percent of a hydrocarbon lubricating oil and 74 weight percent of a zinc dialkyl dithiophosphate prepared from a mixture of acids derived from 65% isobutyl alcohol and 35% primary amyl alcohol; (2) 98.5 weight percent of a medium viscosity index, solvent-extracted, paraffinic mineral oil having a viscosity at 210° F. of approximately 69 S.U.S., a pour point of +5° F. (maximum), a flash point (Cleveland Open Cup) of 410° F. minimum, and a V.I. of 90 minimum;

and (3) 0.3 weight percent of a wax alkylated naphthalene pour point depressant.

The resulting oil composition containing the above motor oil blend and additive of Example 1 is clear, stable and haze-free.

Example 3

The blended motor oil of Example 2 containing the additive of the present invention produced in Example 1 is tested for rust inhibition. To determine rust inhibition, the General Motors MS test series is used, employing a sequential MSIIB engine merit test. The MSIIB engine test entails running the regular MSIIB low temperature cycle, then disassembling only the parts to be rust rated. The engine crankcase is the drained, filled with new test oil (plus dummy rust test parts) and run to flush the system of all the oil and residue from the first run. The new parts and fresh test oil are placed in the engine for the next run. The MSIIB series of tests is described in ASTM Special Technical Publication 315D.

The MSIIB rust rating varies from 3 to 10 with higher values indicating better results. Values in the range of 8.2 to 9.0 are commonly found in commercially available motor oils.

The blended motor oil of Example 2 containing the additive of the present invention produced in Example 1 has an MSIIB rust rating of 8.6.

Example 4

The blended motor oil described in Example 2 was tested in an "L-38 Engine Test." The L-38 Engine Test is also known as "CLR L-38 Engine Test" and is designed to evaluate high temperature stability of a formulated lubricant oil. Such evaluations include measurement of copper-lead bearing corrosion resulting from the test. In this test a single cylinder water cooled Labeco oil test engine is operated at 3150 r.p.m. for 40 hours with the test oil formulation. The oil is maintained at 300° F. and cooling water is maintained at 195° F. Copper-lead connecting rod bearings are weighed before and after the test. Bearing weight loss (BWL) of 50 milligrams or less is desired.

The blend of Example 2 when tested in the L-38 Engine Test had a bearing weight loss at 100 hours of 35 milligrams which is an excellent value.

In contrast a motor oil formulated as in Example 2 [except that the additive of Example 1, i.e., the reaction product of the half-lithium salt of polyisobutylene succinic acid and pentaerythritol, is replaced with reaction product of one mole of the identical half-lithium salt of polyisobutylene-succinic acid and one-half mole tetraethylene pentamine] developed a bearing weight loss at 100 hours of 120 milligrams.

The invention in its broader aspect is not limited to the specific details shown and described and departures may be made from such details without departing from the principles of the invention and without sacrificing its chief advantages.

What is claimed is:

1. A lubricating oil composition comprising, a major amount of mineral lubricating oil and in the range of about 0.2 to 6 weight percent of an oil soluble rust inhibitor, said rust inhibitor being the half lithium salt of an aliphatic hydrocarbon substituted succinic acid or anhydride which has been esterified with a polyhydric aliphatic alcohol containing up to 40 carbon atoms and having 2 to 10 hydroxy groups, said polyhydric alcohol being partially esterified by said acid or anhydride so that the resulting compound has at least one pendant hydroxy group, and wherein said aliphatic hydrocarbon has a molecular weight in the range of about 750 to about 5000.

2. A lubricating oil composition according to claim 1, wherein said compound has at least two pendant hydroxy groups.

3. A lubricating oil composition according to claim 2, wherein said aliphatic hydrocarbon is an olefin polymer.

4. A lubricating oil composition according to claim 1, wherein said aliphatic hydrocarbon is polyisobutylene and said alcohol is pentaerythritol.

5. A lubricating oil composition according to claim 4, wherein about 0.5 mole of pentaerythritol is reacted per molar proportion of lithium half salt of polyisobutylene succinic acid.

6. An additive concentrate comprising mineral lubricating oil and from 6 to 50 weight percent of an oil soluble rust inhibitor, said rust inhibitor being the half-lithium salt of an aliphatic hydrocarbon substituted succinic acid or anhydride which has been esterified with a polyhydric aliphatic alcohol containing up to 40 carbon atoms and having 2 to 10 hydroxy groups, said polyhydric alcohol being partially esterified by said acid or anhydride so that the resulting compound has at least one pendant hydroxy group, and wherein said aliphatic hydrocarbon has a molecular weight in the range of about 750 to about 5000.

* * * * *